US010421173B2

(12) United States Patent
Lin et al.

(10) Patent No.: US 10,421,173 B2
(45) Date of Patent: Sep. 24, 2019

(54) BASE LAYER, POLISHING PAD WITH BASE LAYER, AND POLISHING METHOD

(71) Applicant: IV Technologies CO., Ltd., Taichung (TW)

(72) Inventors: Geng-I Lin, Taipei (TW); Yu-Hao Pan, Taichung (TW); Kun-Che Pai, Taichung (TW)

(73) Assignee: IV Technologies CO., Ltd., Taichung (TW)

( * ) Notice: Subject to any disclaimer, the term of this patent is extended or adjusted under 35 U.S.C. 154(b) by 176 days.

(21) Appl. No.: 15/598,319

(22) Filed: May 18, 2017

(65) Prior Publication Data

US 2017/0334033 A1 Nov. 23, 2017

(30) Foreign Application Priority Data

May 20, 2016 (TW) ..... 105115643 A

(51) Int. Cl.

| | |
|---|---|
| ***B24B 37/22*** | (2012.01) |
| ***B24D 11/00*** | (2006.01) |
| ***B24B 37/24*** | (2012.01) |
| ***B24D 18/00*** | (2006.01) |

(52) U.S. Cl.

CPC ..... *B24B 37/22* (2013.01); *B24B 37/24* (2013.01); *B24D 11/00* (2013.01); *B24D 18/0045* (2013.01)

(58) Field of Classification Search

CPC ..... B24B 37/22; B24B 37/24; B24D 11/00; B24D 18/0045

See application file for complete search history.

(56) References Cited

U.S. PATENT DOCUMENTS

| | | | | |
|---|---|---|---|---|
| 4,728,552 A * | 3/1988 | Jensen, Jr. | ..... | B24B 37/24 101/376 |
| 5,989,113 A * | 11/1999 | Arnold | ..... | B24D 11/02 451/526 |
| 7,134,953 B2 * | 11/2006 | Reinke | ..... | B24D 11/06 451/530 |

(Continued)

FOREIGN PATENT DOCUMENTS

| | | |
|---|---|---|
| CN | 2897550 | 5/2007 |
| CN | 104786137 | 7/2015 |

OTHER PUBLICATIONS

Office Action of China Counterpart Application, dated Nov. 1, 2018, pp. 1-14.

*Primary Examiner* — Timothy V Eley
(74) *Attorney, Agent, or Firm* — JCIPRNET

(57) ABSTRACT

A base layer, a polishing pad with a base layer and a polishing method are provided. The polishing pad includes a polishing layer and a base layer. The base layer, underlaid below the polishing layer, is a three-dimensional fabric. The three-dimensional fabric comprises a top woven layer, a bottom woven layer, and a supporting woven layer disposed between the top woven layer and the bottom woven layer. The top woven layer and the bottom woven layer are respectively woven by a plurality of first set of yarns and a plurality of second set of yarns. The supporting woven layer comprises a plurality of supporting yarns interconnecting the top woven layer and the bottom woven layer, so that a space exists between the top woven layer and the bottom woven layer.

28 Claims, 3 Drawing Sheets

(56) References Cited

U.S. PATENT DOCUMENTS

| | | | | |
|---|---|---|---|---|
| 10,022,835 | B2 * | 7/2018 | Feng | B24B 37/22 |
| 10,022,836 | B2 * | 7/2018 | Feng | B24B 37/22 |
| 2009/0047877 | A1 * | 2/2009 | Muldowney | B24B 37/22<br>451/59 |

* cited by examiner

BASE LAYER, POLISHING PAD WITH BASE LAYER, AND POLISHING METHOD

CROSS REFERENCE TO RELATED APPLICATION

This application claims the priority benefits of Taiwan application serial no. 105115643, filed on May 20, 2016. The entirety of the above-mentioned patent application is hereby incorporated by reference herein and made a part of specification.

BACKGROUND OF THE INVENTION

Field of the Invention

The invention relates to a base layer, a polishing pad, and a polishing method; particularly, the invention relates to a base layer with a three-dimensional fabric, a polishing pad with the aforementioned base layer, and a polishing method.

Description of Related Art

A planarization process is often taken as the process for manufacturing elements of all kinds as the industry progresses from time to time. In the planarization process, a polishing process is usually applied. The polishing process is to attach a to-be-polished object to a polishing head of a polishing system and exert a pressure to press the to-be-polished object onto the polishing pad. The surface of the to-be-polished object is gradually planarized through the relative motion between the to-be-polished object and the polishing pad. Apart from that, a polishing slurry containing chemical mixtures may also be applied on the polishing pad by choice during the polishing process. The surface of the to-be-polished object is polished and planarized through the coaction between mechanical and chemical effects.

Most of the polishing pads that are currently used in the industry have a multi-layered structure due to the needs of certain polishing processes. The polishing pad includes a polishing layer and a base layer which is adhered to the bottom of the polishing layer and is fixed to a polishing platen. To achieve better uniformity in the polishing process, the base layers of the polishing pads are usually made of materials with greater compression ratio. The materials of the base layers may include, for example, a porous structure. The base layers included in the polishing pads used in general industries may be roughly divided into two major categories: non-woven fabric materials impregnated with resin and foaming materials. However, it is difficult to look after both the tensile strength which is parallel to the direction of the polishing surface (which is the direction of the X-Y axis) and the compression ratio which is perpendicular to the direction of the polishing surface (which is the direction of the Z axis) of the traditional base layers. For instance, the base layer with greater compression ratio is able to accomplish better buffer effect, but the tensile strength of the base layer is relatively small. In other words, the deformation amount of the base layer in the direction of the X-Y axis is greater when the polishing pad is affected by the stress resulting from the polishing process. Thereby, it is more likely to cause delamination on the interface between the polishing layer and the base layer or on the interface between the base layer and the polishing platen, or it is more likely to generate air bubbles on the interfaces, which may affect the reliability of the polishing pad and may even lead to scratches of or damages to the polished objects.

As a result, the industry is still in need of a polishing pad, of which the base layer has both good tensile strength and appropriate compression ratio, so as to increase the polishing reliability.

SUMMARY OF THE INVENTION

The invention provides a base layer, a polishing pad with a base layer, and a polishing method to increase the polishing reliability of the polishing pad.

In an embodiment of the invention, a base layer is adapted to underlay a polishing layer of a polishing pad. The base layer is a three-dimensional fabric and includes a top woven layer, a bottom woven layer, and a supporting woven layer. The supporting woven layer is disposed between the top woven layer and the bottom woven layer. The top woven layer and the bottom woven layer are respectively formed by interweaving a plurality of first set of yarns and a plurality of second set of yarns. The supporting woven layer includes a plurality of supporting yarns interconnecting the top woven layer and the bottom woven layer, such that a space exists between the top woven layer and the bottom woven layer.

In an embodiment of the invention, a base layer is adapted to underlay a polishing layer of a polishing pad. The base layer is a three-dimensional fabric with an average tensile strength greater than 50 $kgf/cm^2$ and a compression ratio greater than 11%.

In an embodiment of the invention, a polishing pad includes a polishing layer and a base layer underlaid below the polishing layer. The base layer is a three-dimensional fabric and includes a top woven layer, a bottom woven layer, and a supporting woven layer. The supporting woven layer is disposed between the top woven layer and the bottom woven layer. The top woven layer and the bottom woven layer are formed by interweaving a plurality of first set of yarns and a plurality of second set of yarns, such that a space exists between the top woven layer and the bottom woven layer.

In an embodiment of the invention, a polishing pad includes a polishing pad and a base layer underlaid below the polishing layer. The base layer is a three-dimensional fabric with an average tensile strength greater than 50 $kgf/cm^2$ and a compression ratio greater than 11%.

In an embodiment of the invention, a polishing method is adapted to polish an object and includes providing a polishing pad, exerting a pressure on the object to press the object onto the polishing pad, and relatively moving the object and the polishing pad.

Based on the above, since the polishing pad provided in the invention includes the polishing layer and the base layer constructed by the three-dimensional fabric, the polishing reliability can be enhanced.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
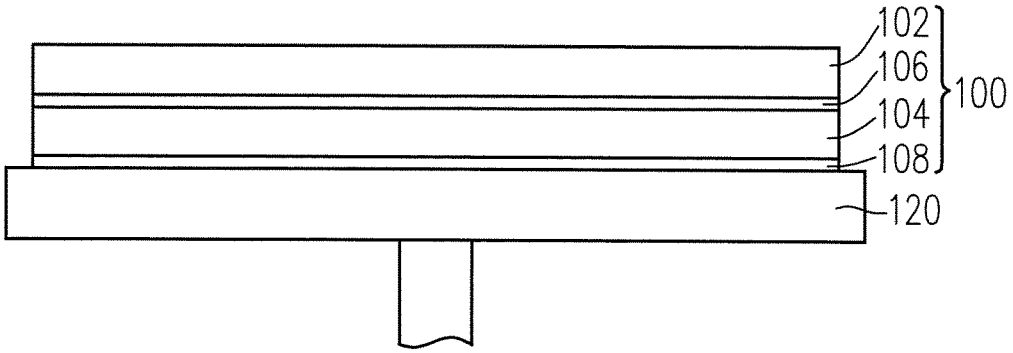
FIG. 1 is a schematic view showing that a polishing pad with a base layer is applied in a polishing system in an embodiment of the invention.

It should be understood that the foregoing and other detailed descriptions, features, and effects are intended to be described more comprehensively by providing embodiments accompanied with drawings hereinafter. In the following embodiments, wording used to indicate directions, such as "up," "down," "front," "back," "left," and "right," merely refers to directions in the accompanying drawings. Therefore, the directional wording is used to illustrate rather than limit the disclosure. Moreover, the same or similar reference numerals represent the same or similar elements in the following embodiments.

FIG. 1 is a schematic view showing that a polishing pad with a base layer is applied in a polishing system in an embodiment of the invention. According to the embodiment of the invention, a polishing pad 100 includes a polishing layer 102 and a base layer 104. The base layer 104 is underlaid below the polishing layer 102.

In the embodiment of the invention, the polishing layer 102 is, for example, constructed by a polymer base material, such as polyester, polyether, polyurethane, polycarbonate, polyacrylate, polybutadiene, or other polymer base materials synthesized by proper thermosetting resin or thermoplastic resin. The polishing layer 102 including the polymer base material may also include conductive materials, abrasives, micro-spheres, or soluble additives in the polymer base material.

The material of the base layer 104 is, for example, a three-dimensional fabric. The three-dimensional fabric is, for example, a three-dimensional structure with regularly and repeatedly arranged patterns. For better understanding of the embodiments of the invention, please refer to FIGS. 2A, 2B, and 2C hereinafter.

Figure 2A:
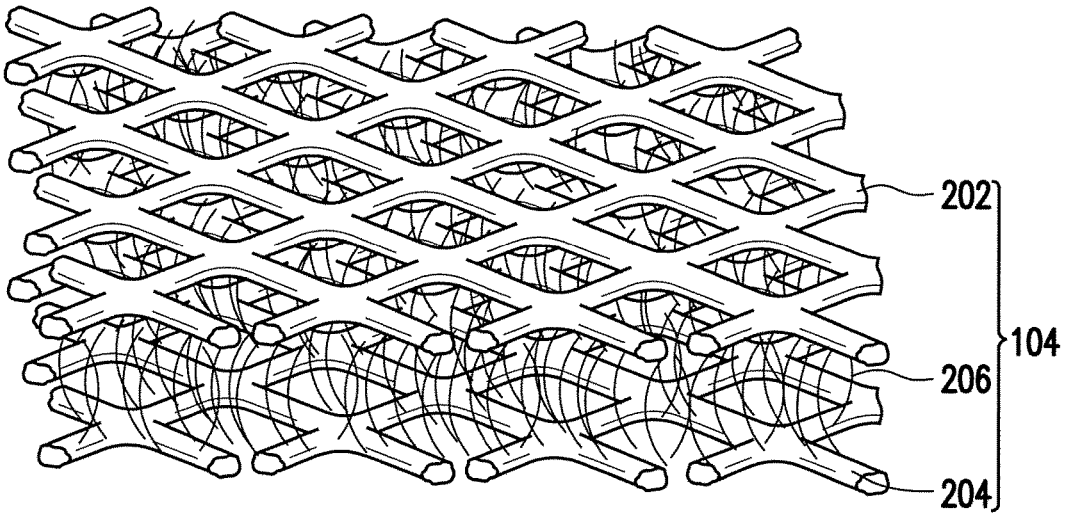
FIG. 2A is a schematic enlarged view of a portion of a base layer in an embodiment of the invention.

FIG. 2A is a schematic enlarged view of a portion of a base layer in an embodiment of the invention. In the embodiment of the invention, the base layer 104 include a top woven layer 202, a bottom woven layer 204, and a supporting woven layer 206 disposed between the top woven layer 202 and the bottom woven layer 204. The top woven layer 202 and the bottom woven layer 204 are respectively formed by interweaving a plurality of first set of yarns and a plurality of second set of yarns. The supporting woven layer 206 includes a plurality of supporting yarns interconnecting the top woven layer 202 and the bottom woven layer 204, such that a space exists between the top woven layer 202 and the bottom woven layer 204. The top woven layer 202 and the bottom woven layer 204 are respectively a planar grid structure formed by interweaving a plurality of the first set of yarns and a plurality of the second set of yarns. To be more specific, the first set of yarns and the second set of yarns respectively extend in a direction of a plane constructed by an X-Y axis and are interwoven in a regular and repeated manner to form a grid. The plurality of the first set of yarns, the plurality of the second set of yarns, or the plurality of supporting yarns in the invention refer to a plurality of yarns distributed in the same extending direction. In other words, the plurality of yarns distributed in the same extending direction may be constructed by one yarn arranged in a back and forth manner. The invention is not limited to the above.

In an embodiment of the invention, as shown in FIG. 2A, a top woven layer 202 and a bottom woven layer 204 are respectively a planar grid structure formed by interweaving a plurality of first set of yarns and a plurality of second set of yarns respectively extending in a direction of a plane constructed by an X-Y axis. The first set of yarns may be, for example, warp yarns and the second set of yarns may be, for example, weft yarns. The invention is not limited to the above. In another embodiment, the first set of yarns may be, for example, weft yarns and the second set of yarns may be, for example, warp yarns. Furthermore, the top woven layer 202 and the bottom woven layer 204 are in a shape of rectangular grids formed by interweaving a plurality of parallel warp yarns and a plurality of parallel weft yarns perpendicularly arranged in a regular and repeated manner. In another embodiment, however, the first set of yarns and the second set of yarns may not be perpendicular to each other, such that the interwoven first and second sets of yarns may form grids in a shape of a rhombus or a parallelogram. Note that the invention is not limited to the above. Moreover, the top woven layer 202 and the bottom woven layer 204 may include grids in a shape of a triangle, a hexagon, an octagon, in another shape, or a combination of any of the shapes mentioned above, and the grids may be formed by interweaving three or more sets of yarns. It should be mentioned that the invention is not limited to the above, and the shapes of grids may be adjusted in accordance with actual demands.

The top woven layer 202 and the bottom woven layer 204 shown in FIG. 2A have grids of the same shape. The top woven layer 202 and the bottom woven layer 204 are not tightly interwoven, thus resulting in holes between the grids. Nevertheless, the invention is not limited to the above. In another embodiment of the invention, the top woven layer 202 and the bottom woven layer 204 may be arranged in grids with different shapes formed by applying different weaving methods. In yet another embodiment of the invention, the top woven layer 202 and the bottom woven layer 204 arranged in grids of the aforesaid shapes may be tightly interwoven, thus resulting in no holes between the grids.

The supporting woven layer 206 includes a plurality of supporting yarns which are disposed between the top woven layer 202 and the bottom woven layer 204 and extend in a direction of a Z axis. In an embodiment of the invention, the supporting yarns in the supporting woven layer 206 are interwoven with a portion of first set of yarns or a portion of second set of yarns of the top woven layer 202 and the bottom woven layer 204. In another embodiment of the invention, the supporting yarns of the supporting woven layer 206 are interwoven with all of the first set of yarns and/or all of the second set of yarns of the top woven layer 202 and the bottom woven layer 204. To be more specific, the supporting yarns of the supporting woven layer 206 extend upwards in the direction of the Z axis and are regularly and repeatedly arranged in comparison with the first set of yarns and the second set of yarns which extend in the direction of the plane constructed by the X-Y axis. Thereby, the supporting yarns of the supporting woven layer 206 are capable of supporting the top woven layer 202 and the bottom woven layer 204, such that a space exists between the top woven layer 202 and the bottom woven layer 204, and that the top woven layer 202 and the bottom woven layer 204 are not in contact with each other.

Figure 2B:
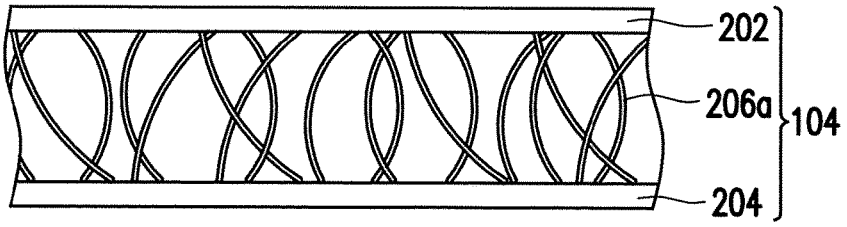
FIG. 2B is a schematic enlarged cross-sectional side view of a portion of a base layer in an embodiment of the invention.

FIG. 2B is a schematic enlarged cross-sectional side view of a portion of a base layer in an embodiment of the invention. According to FIG. 2B, it is evident that a supporting woven layer 206*a* disposed between the top woven layer 202 and the bottom woven layer 204 is constituted by the supporting yarns arranged in the Z axis in a shape of multi-directional arcs. The supporting woven layer 206*a* may also be constituted by the supporting yarns in a shape of single-directional arcs or in another shape, such as a ring shape, a spiral shape, an irregular shape, a shape of straight lines, or a combination thereof. Nevertheless, the invention is not limited thereto.

Figure 2C:
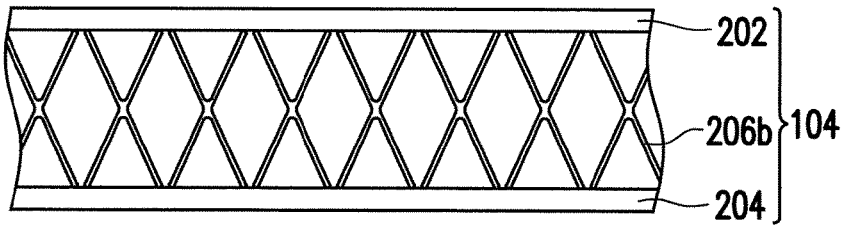
FIG. 2C is a schematic enlarged cross-sectional side view of a portion of a base layer in another embodiment of the invention.

The supporting yarns in the supporting woven layer 206*a* disposed between the top woven layer 202 and the bottom woven layer 204 are not interwoven. In another embodiment of the invention, as shown in FIG. 2C, supporting yarns of a supporting woven layer 206*b* may alternatively be interwoven in an X shape, an S shape, a shape of a triangle, a shape of a rectangle, a shape of a hexagon, or a combination thereof. Nevertheless, the invention is not limited thereto.

In the embodiment of the invention, the material of the three-dimensional fabric may include, for example, polyester fibers, nylon fibers, elastic fibers, glass fibers, carbon fibers, Kevlar fibers, or a combination thereof. The material of the three-dimensional fabric may also include natural fibers or other suitable fibers by choice; however, the invention is not limited to the above. The aforementioned fibers may undergo a spinning process and a weaving process to form a three-dimensional fabric, and the resultant three-dimensional fabric may be, for example, a hollow three-dimensional structure having double-sided meshes and featuring air permeability on the six surfaces, i.e., the front, back, top, bottom, left, and right surfaces. Nevertheless, the invention is not limited to the above.

Since the base layer 104 is constructed by the three-dimensional fabric, it should be mentioned that the top woven layer 202 and the bottom woven layer 204 of the three-dimensional fabric enable the base layer 104 to have a greater tensile strength. The average tensile strength of the base layer 104 is greater than 50 kgf/cm$^2$, greater than 60 kgf/cm$^2$ or greater than 70 kgf/cm$^2$. Moreover, the supporting woven layer 206 of the three-dimensional fabric also enables the base layer 104 to have a greater compression ratio. The compression ratio of the base layer 104 is greater than 11%. (e.g., greater than 13%, greater than 15%, or greater than 17%). Thereby, the base layer provided in the invention can have a greater compression ratio and a greater tensile strength to increase the polishing reliability.

Please refer to FIG. 1. In the embodiment of the invention, the polishing pad 100 further includes a first adhesive layer 106 and a second adhesive layer 108. The first adhesive layer 108 is disposed between the polishing layer 102 and the base layer 104. That is to say, the first adhesive layer 106 adheres a bottom of the polishing layer 102 to the top woven layer 202 (not shown in FIG. 1) of the base layer 104. The material of the first adhesive layer 106 may be, for example, a UV-curable adhesive, a hot-melt adhesive, or a moisture-curable adhesive. Nevertheless, the invention is not limited to the above. The second adhesive layer 108 is disposed at a bottom of the base layer 104. That is to say, the second adhesive layer 108 adheres the bottom woven layer 204 (not shown in FIG. 1) of the base layer 104 onto a polishing platen 120. The second adhesive layer 108 is, for example, a double-sided adhesive layer. Furthermore, a third adhesive layer (not shown in the figures) may be further included between the bottom of the base layer 104 and the second adhesive layer 108. The material of the third adhesive layer may be, for example, a UV-curable adhesive, a hot-melt adhesive, or a moisture-curable adhesive, which should not be construed as a limitation to the invention.

Table 1 below is a comparison table of test results on physical properties of a non-woven fabric impregnated with resin in a conventional base layer, foaming materials in a traditional base layer and the three-dimensional fabric of the base layer provided in the invention.

TABLE 1

| | Non-woven Fabric Impregnated with Resin | Foaming Material A | Foaming Material B | 3-dimen-tional Fabric A | 3-dimen-tional Fabric B |
|---|---|---|---|---|---|
| Thickness (mm) | 1.36 | 1.08 | 1.08 | 1.34 | 1.17 |
| Tensile Strength MD (kgf/cm$^2$) | 32.6 | 48.4 | 10.9 | 62.3 | 64.8 |
| Tensile Strength TD (kgf/cm$^2$) | 49.6 | 32.6 | 8.9 | 92.8 | 104.2 |
| Average Tensile Strength (kgf/cm$^2$) | 41.1 | 40.5 | 9.9 | 77.6 | 84.5 |
| Compression Ratio (%) | 10.8 | 5.9 | 4.7 | 29.1 | 17.1 |

Notes:
1. MD (Machine Direction) is a moving direction; TD (Transverse Direction) is a direction of width.
2. Testing samples and methods of tensile strength follow the standards of CNS10487, and the tensile strengths of the samples are recorded when the amount of elongation of the samples is 15 mm.

According to Table 1, the compression ratios of the three-dimensional fabrics A and B of the base layers of the invention are 29.1% and 17.1%, respectively. The compression ratio of the non-woven fabric impregnated with resin of the traditional base layer is 10.8%. Further, the compression ratios of the foaming materials A and B of the traditional base layers are 5.9% and 4.7%, respectively. Since the three-dimensional fabric provided herein has greater compression ratio, the base layer of the invention is able to achieve a better buffer effect of the polishing pad. Moreover, the average tensile strengths of the three-dimensional fabrics A and B provided in the invention are 77.6 kgf/cm$^2$ and 84.5 kgf/cm$^2$, respectively. The average tensile strength of the non-woven fabric impregnated with resin of the traditional base layer is 41.1 kgf/cm$^2$. The average tensile strengths of the foaming materials A and B of the traditional base layers are 40.5 kgf/cm$^2$ and 9.9 kgf/cm$^2$ respectively. Since the three-dimensional fabric of the base layer provided in the invention has the greater average tensile strength, the deformation amount of the base layer in the direction of the X-Y axis is smaller when the polishing pad is affected by a stress resulting from a polishing process. Delaminations on the interface of the polishing layer and the base layer or on the interface of the base layer and the polishing platform are thus avoided. Scratches of or damages to the polished objects caused by the air bubbles on the interfaces are also avoided. Based on the above, the base layer described herein has the greater compression ratio and the greater tensile strength, so as to ensure favorable polishing reliability.

Figure 3:
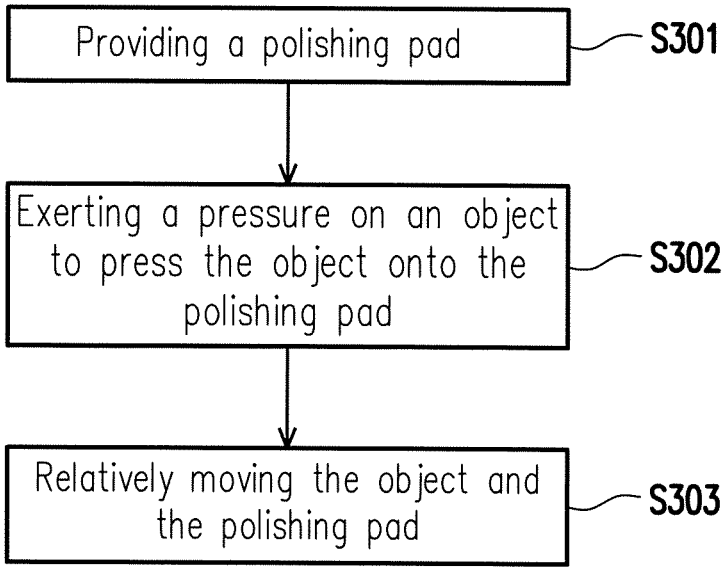
FIG. 3 is a flow chart of a polishing method in an embodiment of the invention.

Additionally, the polishing method provided in the invention is adapted to polish an object by applying the polishing pad disclosed in the invention in the polishing process. Please refer to FIG. 3. The first step S301 is to provide a polishing pad. The polishing pad includes a polishing layer and a base layer, which is a three-dimensional fabric underlaid below the polishing layer. Next, in step S302, a pressure is exerted on an object to press the object onto the polishing pad, so as to make the object contact the polishing pad. Afterwards, in step S303, the object and the polishing pad are relatively moved to planarize the object by polishing the object with the polishing pad. Descriptions regarding the polishing pad are not repeated herein, and please refer to the aforementioned embodiments for related descriptions.

The polishing pad in each of the aforementioned embodiments may be applied in the polishing equipment and the manufacturing process during the manufacture of, for example, a semiconductor, an integrated circuit, a micro-electro-mechanic device, an energy transformation device, a communication device, an optical device, a storage disc, a display, and other devices. The to-be-polished objects used to manufacture such devices may include a semiconductor wafer, a group III-V wafer, a storage device carrier, a ceramic substrate, a polymer substrate, a glass substrate, etc., which should however not be construed as limitations to the invention.

To sum up, the base layer, the polishing pad with the base layer, and the polishing method provided in the invention allow the increase in the polishing reliability through providing the polishing pad with the base layer made of three-dimensional fabric.

It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A base layer adapted to underlay a polishing layer of a polishing pad, the base layer being a three-dimensional fabric and comprising:

a top woven layer;

a bottom woven layer; and a supporting woven layer disposed between the top woven layer and the bottom woven layer, wherein the top woven layer and the bottom woven layer are respectively formed by interweaving a plurality of first set of yarns and a plurality of second set of yarns, and the supporting woven layer comprises a plurality of supporting yarns interconnecting the top woven layer and the bottom woven layer, such that a space exists between the top woven layer and the bottom woven layer.

2. The base layer according to claim 1, wherein the three-dimensional fabric comprises a three-dimensional structure with regularly and repeatedly arranged patterns.

3. The base layer according to claim 1, wherein the first set of yarns and the second set of yarns extend respectively in a direction of a plane constructed by an X-Y axis and are interwoven in a regular and repeated manner to form a grid.

4. The base layer according to claim 3, wherein a shape of the grid comprises a square, a rhombus, a parallelogram, a triangle, a hexagon, an octagon, or a combination thereof.

5. The base layer according to claim 1, wherein the top woven layer and the bottom woven layer are tightly interwoven or not tightly interwoven.

6. The base layer according to claim 1, wherein the supporting yarns and at least a portion of the first set of yarns of the top woven layer and the bottom woven layer are interwoven, or the supporting yarns and at least a portion of the second set of yarns of the top woven layer and the bottom woven layer are interwoven.

7. The base layer according to claim 1, wherein the supporting yarns extend in a direction of a Z-axis and are regularly and repeatedly arranged.

8. The base layer according to claim 1, wherein the supporting yarns are not interwoven or are interwoven.

9. The base layer according to claim 8, wherein the supporting yarns are not interwoven, and the supporting yarns are arranged in a shape of multi-directional arcs, a shape of single-directional arcs, a ring shape, a spiral shape, a shape of straight lines, or a combination thereof.

10. The base layer according to claim 8, wherein the supporting yarns are interwoven in an X shape, an S shape, a shape of a triangle, a shape of a rectangle, a shape of a hexagon, or a combination thereof.

11. The base layer according to claim 1, wherein a material of the three-dimensional fabric comprises polyester fibers, nylon fibers, elastic fibers, glass fibers, carbon fibers, Kevlar fibers, natural fibers, or a combination thereof.

12. The base layer according to claim 1, wherein the base layer is with an average tensile strength greater than 50 $kgf/cm^2$ and a compression ratio greater than 11%.

13. A polishing pad, comprising:

a polishing layer; and a base layer underlaid below the polishing layer, the base layer being a three-dimensional fabric and comprising:

a top woven layer;

a bottom woven layer; and a supporting woven layer disposed between the top woven layer and the bottom woven layer, wherein the top woven layer and the bottom woven layer are respectively formed by interweaving a plurality of first set of yarns and a plurality of second set of yarns, the supporting layer comprises a plurality of supporting yarns interconnecting the top woven layer and the bottom woven layer, such that a space exists between the top woven layer and the bottom woven layer.

14. A polishing method adapted to polish an object, the polishing method comprising:

providing the polishing pad according to claim 13;

exerting a pressure on the object to press the object onto the polishing pad; and relatively moving the object and the polishing pad.

15. The polishing pad according to claim 13, wherein the base layer is a three with an average tensile strength greater than 50 $kgf/cm^2$ and a compression ratio greater than 11%.

16. The polishing pad according to claim 13, wherein the three-dimensional fabric has a three-dimensional structure with regularly and repeatedly arranged patterns.

17. The polishing pad according to claim 13, wherein the first set of yarns and the second set of yarns extend respectively in a direction of a plane constructed by an X-Y axis and are interwoven in a regular and repeated manner to form a grid, wherein a shape of the grid comprises a square, a rhombus, a parallelogram, a triangle, a hexagon, an octagon, or a combination thereof.

18. The polishing pad according to claim 13, wherein the top woven layer and the bottom woven layer are tightly interwoven or are not tightly interwoven.

19. The polishing pad according to claim 13, wherein the supporting yarns and at least a portion of the first set of yarns of the top woven layer and the bottom woven layer are interwoven, or the supporting yarns and at least a portion of the second set of yarns of the top woven layer and the bottom woven layer are interwoven.

20. The polishing pad according to claim 13, wherein the supporting yarns extend in a direction of a Z-axis and are regularly and repeatedly arranged.

21. The polishing pad according to claim 13, wherein the supporting yarns are not interwoven, and the supporting yarns are arranged in a shape of multi-directional arcs, a shape of single-directional arcs, a ring shape, a spiral shape, an irregular shape, a shape of straight lines, or a combination thereof.

22. The polishing pad according to claim 13, wherein the supporting yarns are interwoven in an X shape, an S shape, a shape of a triangle, a shape of a rectangle, a shape of a hexagon, or a combination thereof.

23. The polishing pad according to claim 13, wherein a material of the three-dimensional fabric comprises polyester fibers, nylon fibers, elastic fibers, glass fibers, carbon fibers, Kevlar fibers, natural fibers, or a combination thereof.

24. The polishing pad according to claim 13, further comprising a first adhesive layer disposed between the polishing layer and the base layer, wherein the first adhesive layer adheres a bottom of the polishing layer to the top woven layer of the base layer.

25. The polishing pad according to claim 24, wherein the first adhesive layer comprises a UV-curable adhesive, a hot-melt adhesive, or a moisture-curable adhesive.

26. The polishing pad according to claim 13, further comprising a second adhesive layer disposed on a bottom of the base layer, wherein the second adhesive layer is capable of adhering the bottom woven layer of the base layer to a polishing platen.

27. The polishing pad according to claim 26, wherein the second adhesive layer is a double-sided adhesive layer.

28. The polishing pad according to claim 27, wherein the polishing layer further comprises a third adhesive layer disposed between the bottom of the base layer and the second adhesive layer, and the third adhesive layer comprises a UV-curable adhesive, a hot-melt adhesive, or a moisture-curable adhesive.

* * * * *